US008991978B2

(12) United States Patent
Rice et al.

(10) Patent No.: US 8,991,978 B2
(45) Date of Patent: Mar. 31, 2015

(54) INK PEN ELECTRICAL INTERFACE

(75) Inventors: Huston W. Rice, Vancouver, WA (US); Kenneth Hickey, Dublin (IE); Jason M. Quintana, Brush Prairie, WA (US); Trudy Benjamin, Portland, OR (US); Joseph M. Torgerson, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/696,758

(22) PCT Filed: May 11, 2010

(86) PCT No.: PCT/US2010/034342

§ 371 (c)(1),
(2), (4) Date: Nov. 7, 2012

(87) PCT Pub. No.: WO2011/142746

PCT Pub. Date: Nov. 17, 2011

(65) Prior Publication Data

US 2013/0050344 A1 Feb. 28, 2013

(51) Int. Cl.
*B41J 2/16* (2006.01)
*B41J 2/14* (2006.01)

(52) U.S. Cl.
CPC ..... *B41J 2/14072* (2013.01); *Y10T 29/49117* (2015.01)
USPC ..... 347/50

(58) Field of Classification Search
CPC ..... B41J 2/14072; B41J 2/25; B41J 2/255; B41J 2002/14491; B41J 19/202; B41J 2/17526; B41J 2/1753
USPC ..... 347/50, 43
See application file for complete search history.

(56) References Cited

U.S. PATENT DOCUMENTS

| | | | | |
|---|---|---|---|---|
| 5,610,642 | A * | 3/1997 | Nobel et al. | 347/50 |
| 5,796,417 | A * | 8/1998 | Nobel | 347/50 |
| 6,003,974 | A * | 12/1999 | Wilson et al. | 347/50 |
| 6,234,598 | B1 | 5/2001 | Torgerson et al. | |
| 6,536,871 | B1 * | 3/2003 | Haddick et al. | 347/50 |
| 6,604,814 | B2 | 8/2003 | Browning et al. | |
| 7,104,624 | B2 * | 9/2006 | Schloeman et al. | 347/12 |
| 7,896,472 | B2 * | 3/2011 | Kondo | 347/50 |
| 2002/0003557 | A1 * | 1/2002 | Miyakoshi et al. | 347/58 |
| 2002/0071004 | A1 * | 6/2002 | Kaneko | 347/58 |
| 2002/0089567 | A1 * | 7/2002 | Sato et al. | 347/50 |
| 2003/0063157 | A1 * | 4/2003 | Browning et al. | 347/50 |
| 2004/0001122 | A1 * | 1/2004 | Miyata | 347/68 |
| 2004/0095437 | A1 * | 5/2004 | Kim et al. | 347/58 |
| 2005/0253883 | A1 * | 11/2005 | Kato | 347/12 |
| 2008/0111859 | A1 | 5/2008 | Kondo | |
| 2010/0128075 | A1 * | 5/2010 | Yamashita | 347/9 |

* cited by examiner

*Primary Examiner* — Matthew Luu
*Assistant Examiner* — Patrick King
(74) *Attorney, Agent, or Firm* — Van Colt, Bagley, Cornwall & McCarthy

(57) ABSTRACT

A printing system comprising an electrical interface for ink pens of an inkjet printer, the electrical interface including a first group of electrical contacts; a second group of electrical contacts, the second group of electrical contacts being arranged in an identical configuration as the first group of electrical contacts; and a number of electrical interconnects, in which each electrical contact from the first and second groups of electrical contacts is connected to one of the electrical interconnects via a conductive trace; in which at least one electrical contact from the first group of electrical contacts is connected to a same electrical interconnect as at least one electrical contact from the second group of electrical contacts.

17 Claims, 5 Drawing Sheets

INK PEN ELECTRICAL INTERFACE

RELATED APPLICATIONS

The present application claims the priority under 35 U.S.C. 119(a)-(d) or (f) and under C.F.R. 1.55(a) of previous International Patent Application No. PCT/US2010/034342, filed May 11, 2010, entitled "Ink Pen Electrical Interface," which is incorporated herein by reference in its entirety.

BACKGROUND

Inkjet printing is a common printing method used for both large scale printing, such as on banners and other signage items, as well as small scale general consumer printing. Inkjet printing generally involves a number of nozzles configured to eject ink onto a substrate or print medium such as paper. The nozzles are part of a print head that is often integrated into an ink pen of an ink cartridge. The ink cartridge includes the main ink reservoir where ink is stored before it is fed to the nozzles for ejection onto the print medium. Ink cartridges are typically placed on a movable platform often referred to as a carriage, that moves the ink cartridges and thus the print head nozzles in relation to the print medium.

An inkjet printer typically includes control circuitry for controlling when the nozzles fire as they move in relation to the print medium. An electrical interface is used to send signals between the carriage and the control circuitry of the printer. This electrical interface includes a number of electrical contacts on the carriage that are configured to contact and electrically interface with corresponding similarly positioned electrical contacts on an ink cartridge disposed on the carriage. The electrical contacts on the carriage are also electrically connected to a number of interconnects leading to the control circuitry of the printer. These interconnects be formed of a flexible conductive material that allows the ink pens on the carriage to receive data from the control circuitry while the carriage is in motion. This data may include which nozzles are to fire at a specific time as the carriage moves across the print medium.

A higher nozzle count within the cartridges allows for a better quality image to be printed onto the print medium. Additionally, the higher nozzle count may allow for printing at higher speeds. However, a higher nozzle count typically requires a larger electrical interface with a greater number of interconnects to carry a great volume of data for controlling the increased number of nozzles. A larger electrical interface usually leads to higher costs. Thus, it may be difficult to balance the demand for high performance printers at moderate cost.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
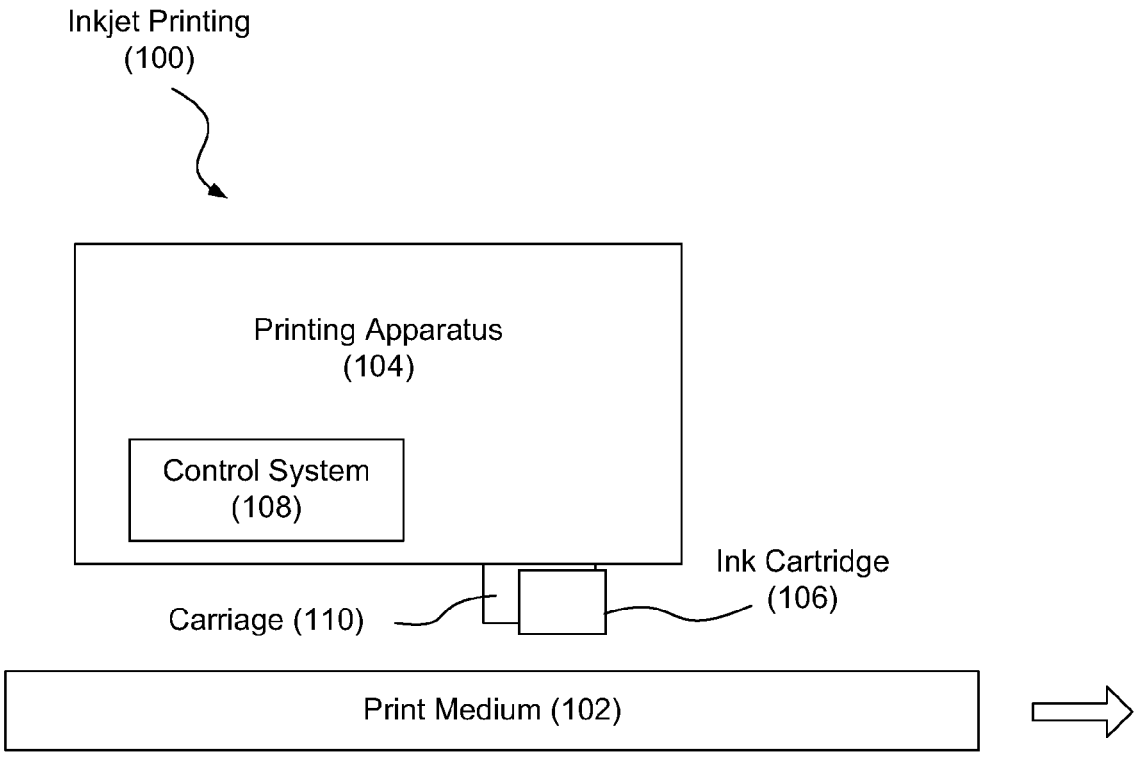
FIG. 1A is diagram showing illustrative inkjet printing principles, according to one example of principles described herein.

As mentioned above, a typical printing system includes an electrical interface on the carriage designed to connect the ink cartridges and pens to the control system of the printer. The electrical interface typically includes enough data lines to address each individual nozzle. In the case of color printing, this includes data lines to address each black ink nozzle as well as each color ink nozzle. As the number of color ink nozzles is often greater than the number of black ink nozzles, more data lines are required to address all the color ink nozzles. The total number of required data lines leads to an increase in cost and design complexity for the printer.

In light of this and other issues, the present specification relates to a printing system that can provide high performance printing at a lower cost. Specifically, the present specification discloses an electrical interface in which at least one of the group of electrical contacts that connect the color ink pen to the control system of a printer is electrically identical to at least one of the group of electrical contacts that connect the black ink pen to the control system of a printer. This allows the sharing of some data lines between the ink pens and the control system of the printer. By sharing lines, the overall number of lines connecting the ink pens to the control system is reduced. Having a smaller number of lines connecting the ink pens to the control system reduces the number of required electrical contacts and electrical interconnects, thus reducing the cost of designing, implementing, and manufacturing such a system.

Additionally, as described herein, a single addressing line may be used to control more than one nozzle of the color ink pen. That is the color ink pen may have more than one physical ink nozzle for each addressable "nozzle." In this way, the interfacing for the color ink pen and the black ink pen becomes more similar in that the color ink pen and the black ink pen may have the same number of addressable nozzles. However, the color ink pen may still have more physical ink nozzles. For example, if each addressable nozzle of the color ink pen includes two physical nozzles, then the color ink pen may have a total physical nozzle count which is twice the nozzle count of the black ink pen without increasing the number of electrical contacts and electrical interconnects on the carriage.

Through use of a printing system embodying principles described herein, a high performance printer at a lower cost may be realized. The cost may be reduced by having a smaller electrical interface between the ink pens and the control system of the printer. The electrical interface may be smaller due to the electrical contacts for the black ink pen and the electrical contacts for the color ink pen being electrically identical, thus allowing the sharing of some data lines between the black and color ink pens and the control system of the printer.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "electrical interface" is to be broadly interpreted as a means for connecting an electrical system of one entity to the electrical system of a second entity. For example, an electrical interface may connect the electrical system of a printer to the electrical system of an ink cartridge.

Throughout this specification and in the appended claims, the term "pen" is to be broadly interpreted as a set of inkjet nozzles that dispense ink of a particular color. An ink cartridge may include one or more pens.

Referring now to the figures, FIG. 1A is a diagram showing an illustrative apparatus for inkjet printing (100). According to certain illustrative examples, a printing apparatus (104) may include a control system (108) and an ink cartridge (106) having a number of inkjet nozzles. The printing apparatus (104) may be configured to transport a sheet of print medium (102) past the nozzles of the ink cartridge (106) as ink is ejected. Additionally or alternatively, the printing apparatus (104) may be configured to move the ink cartridge (106) and nozzles secured to a carriage (110) with respect to the print medium (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the printing apparatus (104). Additionally, the control system (108) may convert the image data received from a client system into a format which is usable by the printing apparatus (104).

The ink cartridge (106) may include one or more ink pens. As the ink cartridge (106) moves with respect to the print medium (102) and/or the print medium (102) moves underneath the ink cartridge (106), the control system (108) may send a signal to the appropriate inkjet nozzle of the ink pen(s) of the ink cartridges (106) to eject an ink droplet. Ink droplets are ejected in a specific pattern so as to create a desired image on the print medium (102).

The inkjet nozzles may be configured to eject ink onto the print medium (102) through a variety of methods. One method, referred to as thermal inkjet printing, includes a small ink firing chamber containing a droplet of ink. A heating resistor is used to heat the firing chamber to a specific temperature when an electric current is applied. Due to various physical properties, this heating increases the pressure inside the firing chamber and propels the droplet out of the nozzle and onto the print medium (102). The void in the chamber then draws in more ink from a main ink reservoir. The control system (108) may be used to cause electric current to flow through the appropriate heating resistors at the appropriate times.

Figure 1B:
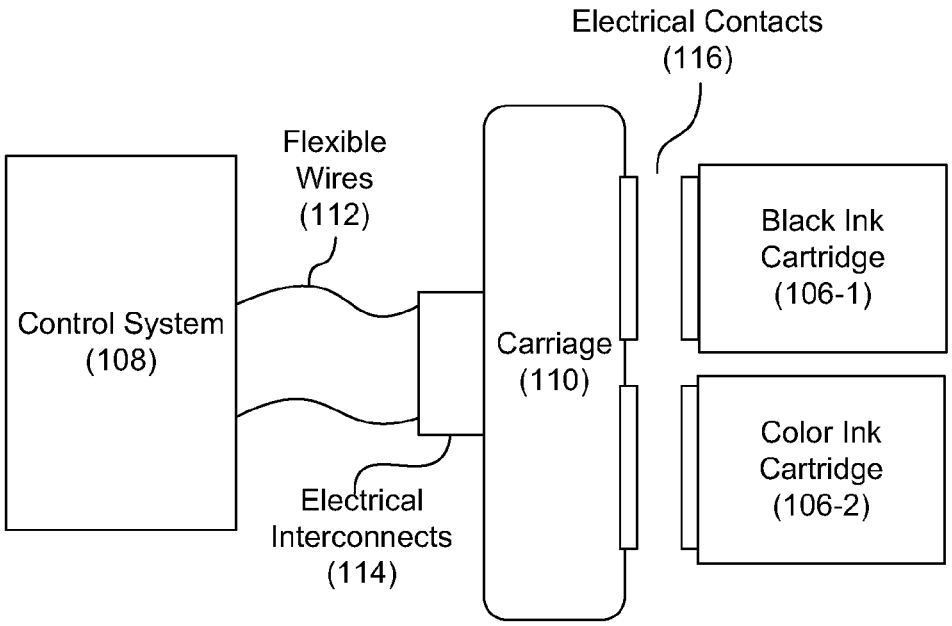
FIG. 1B is a diagram showing the manner in which a control system may communicate with ink cartridges, according to one example of principles described herein.

FIG. 1B is a diagram showing the manner in which a control system (108) may communicate with the ink cartridges (106). According to certain illustrative examples, the control system (108) may communicate with the electrical interface on the carriage (110) through a set of flexible wires (112), which may be arranged as a flat cable. The flexible wires (112) may be connected to a number of electrical interconnects (114) secured to the carriage (110). The electrical interconnects (114) are connected to a set of electrical contacts (116). The electrical contacts (116) are designed to match the electrical contacts of both a black ink cartridge (106-1) and a color ink cartridge (106-2).

The flexible wires (112) may include a number of conductive wires configured to carry data signals between the control system (108) and the carriage (110). The flexibility of the wires (112) allows the connection between the control system (108) and the carriage (110) to be maintained as the carriage (110) moves across the print medium (102). The electrical interconnects (114) may be used to physically connect the flexible wires (112) to the carriage (110). As mentioned above, it is desirable to reduce the number of electrical interconnects (114) and thus the number of flexible wires (112) used by the system. A smaller number of wires and interconnects allows for a less costly system.

As noted above, the electrical interconnects (114) on the carriage may be routed to a number of electrical contacts (116). The position of the electrical contacts (116) is configured to match the position of electrical contacts on both a black ink cartridge (106-1) and a color ink cartridge (106-2). In a typical system, the number of contacts for the color ink cartridge (106-2) may be greater than the number of contacts for a black ink cartridge (106-1). This is because the color ink cartridge includes at least three colors and thus more ink nozzles which need to be addressed.

Figure 2A:
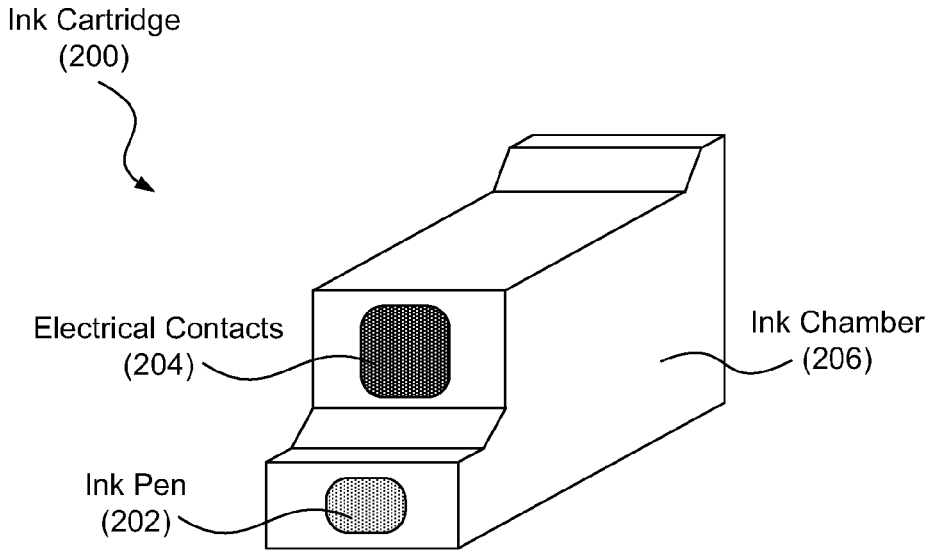
FIG. 2A is a diagram showing a perspective view of an illustrative ink cartridge, according to one example of principles described herein.

FIG. 2A is a diagram showing a perspective view of an illustrative ink cartridge (200). According to certain illustrative examples, the ink cartridge may include at least one ink pen (202), a group of electrical contacts (204) and an ink reservoir (206). Ink cartridges may be designed in a variety of shapes and sizes to fit the specific printers for which they are intended.

The ink pen (202) includes the actual physical nozzles from which ink is ejected onto the print medium. Each physical nozzle may be addressed through a number of electrical control lines that will be described in more detail below.

In some cases, an ink cartridge (200) may contain an ink reservoir (206) for ink of only one color. In other cases, an ink cartridge (200) may include a number of ink reservoirs (206) each storing a different colored ink. Where this is the case, the cartridge typically can include a separate ink pen for dispensing each different color of ink.

Each physical nozzle may be connected to a fire line. The fire line is an electrical line configured to carry an electrical signal of sufficient power to heat a resistor associated with the physical nozzle. The resistor may be configured to get hot enough to propel a small droplet of ink from the firing chamber associated with the nozzle. Upon ejecting the ink from the firing chamber, the void in the firing chamber draws more ink from the main ink reservoir (206).

The various electrical lines such as data lines, select lines, and fire lines may interface with the printer through a group of electrical contacts (204) on the exterior of the ink cartridge (204). The electrical contacts (204) may be made of an electrically conductive material such as a metallic material. The electrical contacts may be designed to make contact with another set of geometrically similar electrical contacts on a carriage (e.g. 110, FIG. 1) associated with the printer. Thus, an electrical signal may travel from the control system of the printer, through an electrical interface on the carriage, to the electrical contacts (204) of the cartridge and, ultimately, to the ink pen (202).

Figure 2B:
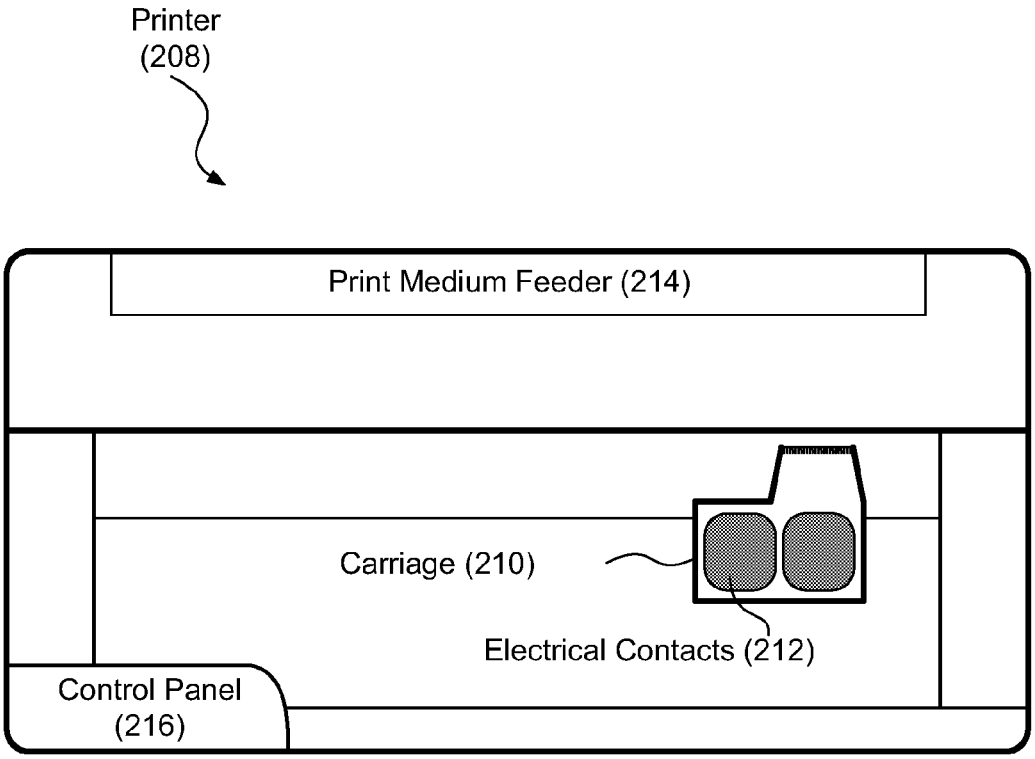
FIG. 2B is diagram showing a top view of an illustrative inkjet printer, according to one example of principles described herein.

FIG. 2B is diagram showing a top view of an illustrative inkjet printer (208). According to certain illustrative examples, the printer may include a carriage (210) having electrical contacts (212) disposed thereon. The printer (208) may also include a print medium feeder (214) and a control panel (216). A typical printer (208) may have a chassis with a hood to cover the carriage (210) from view. The hood may be lifted to replace ink cartridges (200) or perform other maintenance tasks on the printer (208).

The carriage (210) may be configured to securely hold the ink cartridges (200) used by the printer (208). In some examples, a printer (208) may require one ink cartridge which holds ink pens for both black ink and colored inks. In some cases, the printer (208) may be designed to use separate ink cartridges for black ink and colored inks. The carriage (210) may be designed to securely hold the ink cartridges in a manner such that the ink pen (202) of the ink cartridge (200) may be placed within close proximity to a print medium. In this configuration, the carriage (210) is movable along the position under which the print medium will pass. Thus, as the carriage (210) moves, the ink cartridges (200) may receive signals indicating when to fire specific nozzles to form the desired image.

The signals indicating which nozzles are to fire at what time may be received through the electrical interface of the carriage (210). The electrical interface includes the electrical contacts (212) which, as mentioned above, are positioned in a manner similar to the electrical contacts of the ink cartridges (200). A more detailed discussion of the electrical interface will be given below in the text accompanying FIG. 3.

The print medium feeder (214) may be a structure configured to receive a supply or stack of sheets of a print medium to be used for printing. The printer (208) may pull individual sheets of print medium through the printer (208) at the desired speed in order to allow the ink to be printed in the proper locations to form a desired image.

A control panel (216) includes a user interface to allow a user to control or configure the printer and make use of various features and options which are available with the printer (208). The control panel (216) may include such user interface devices, for example, as buttons and a display device.

Figure 3:
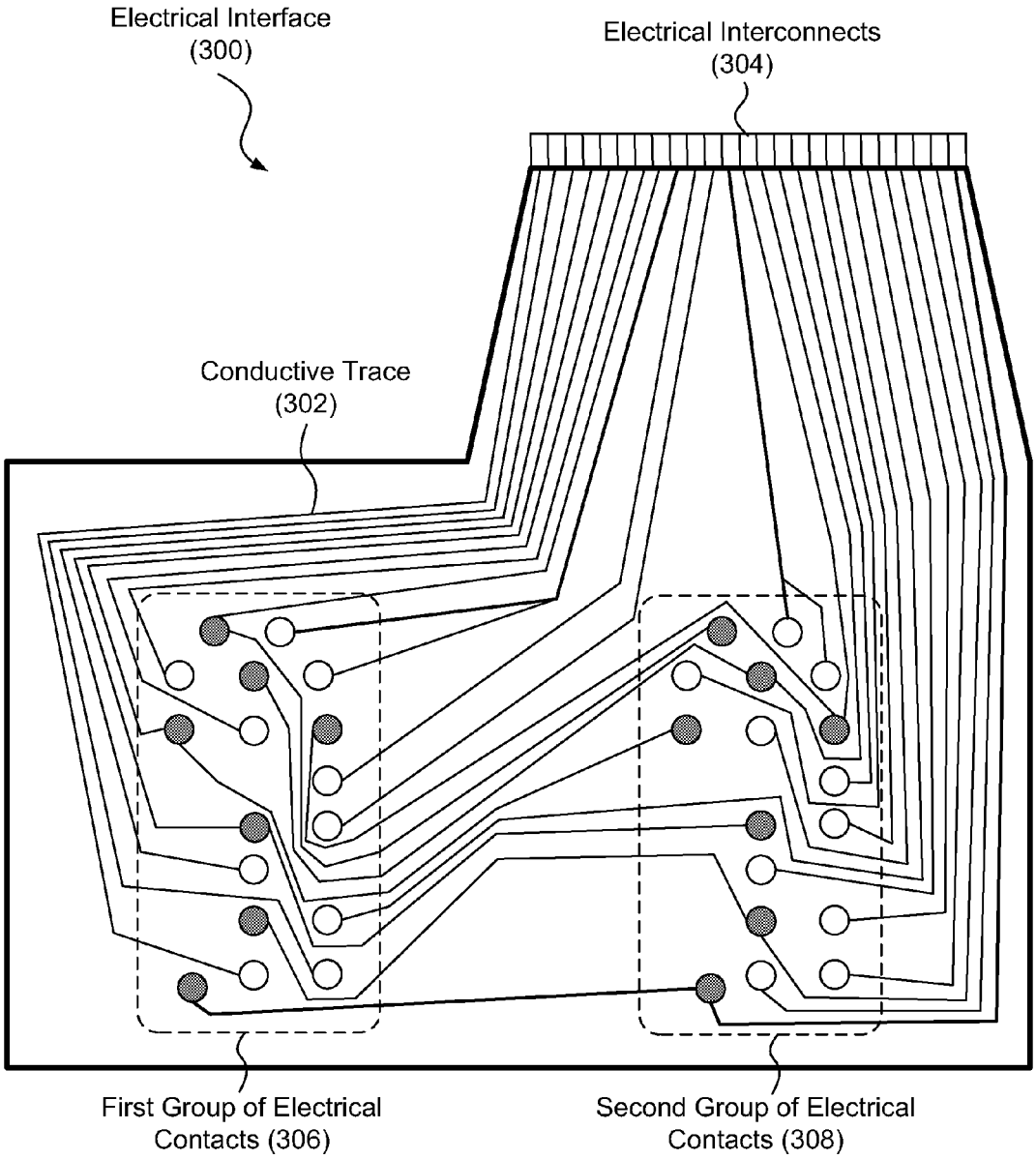
FIG. 3 is a diagram showing an illustrative electrical interface for ink cartridges of an inkjet printer, according to one example of principles described herein.

FIG. 3 is a diagram showing an illustrative electrical interface (300) for ink pens of an inkjet printer. According to certain illustrative examples, the electrical interface (300) may include a first group of electrical contacts (306) and a second group of electrical contacts (308). The electrical contacts from both groups (306, 308) may be connected to a number of electrical interconnects (304) via conductive traces (302). The electrical interface may be associated with a carriage (e.g. 210, FIG. 2).

According to some illustrative examples, the first group of electrical contacts (306) may be configured to interface with a color ink pen. The color ink pen may contain three different colors, for example, yellow, magenta, and cyan. The yellow, magenta, and cyan color scheme is commonly used for printing color images onto a white print medium. These three colors are generally able to produce a color gamut wide enough for standard color images. The second group of electrical contacts (208) may be configured to interface with a black ink pen.

The positions of each electrical contact relative to the other electrical contacts may be arranged so as to allow conductive traces (302) to run from each contact to a corresponding electrical interconnect (304) without requiring any overlapping or crossing of the races (302). The positions may also be arranged to allow the traces to run to similarly positioned electrical contacts from the other group of electrical contacts.

The second group of electrical contacts (308) may be designed to be electrically identical to the first group of electrical contacts. That is, the type of signals carried by a particular electrical contact from the first group (306) can be the same type of signal carried by a similarly positioned electrical contact from the second group (308). For example, the bottom-most left-most contact from each group may be a ground line. In a further example, the top-most left-most contact from each group may be a select line.

Each electrical contact from each group of electrical contacts (306, 308) is connected to one of the electrical interconnects (304). The electrical interconnects (304) may be used to route signals from the printer to the ink pens. As described above, the electrical interconnects (304) may be connected to a set of flexible wires. As the carriage moves along its specified path, the flexible wires bend or straighten as needed to remain connected to the electrical interconnects and provide the electrical connection between the control system of the printer and the ink pens on the carriage.

As mentioned above, reducing the number of electrical interconnects reduces the overall cost of the printer. Thus, it is beneficial for some of the electrical contacts for each group to share the same electrical interconnect (304). In FIG. 3, the shared electrical contacts are denoted by shaded circles. The electrical contacts having a unique (not shared) electrical interconnect are shown as white circles. Some examples of types of electrical lines which may be shared include, but are not limited to, electrical ground lines, select lines, and clock lines. Some examples of types of electrical lines which are unique include, but are not limited to, data lines, fire lines, Thermal Sensor Resistor (TSR) lines, and Identifier (ID) lines.

The conductive traces may be made of an electrically conductive material designed to carry electrical signals. The routing of conductive traces is not limited to the configuration illustrated in FIG. 3. Those skilled in the relevant art can design routing configurations which are appropriate for the layout of electrical contacts from each group (306, 308).

As noted above, the first group of contacts (306) and the second group of electrical contacts (308) may be electrically identical. That is, the each electrical contact in one group is used for the same purpose as a correspondingly-disposed electrical contact in the other group. Having the two groups of electrical contacts (306, 308) be electrically identical allows for the sharing of some lines as illustrated in FIG. 3. By sharing lines, the total number of interconnects (304) and thus flexible wires (112, FIG. 1B) may be reduced. Furthermore, the electrically identical groups of contacts allows for manufacturing the same exterior for both black and color ink cartridges. Thus, in one example, the only difference between a color ink cartridge and a black ink cartridge may be the color of the ink pen placed within the cartridge.

As mentioned above, a color ink pen typically includes more ink nozzles than a black ink pen. As will be apparent to those skilled in the relevant art, it is not possible to individually address each physical nozzle of a color ink pen if the electrical contacts allow for only the same number of addressing contacts as would be used for the ink nozzles of a black ink pen.

Figure 4:
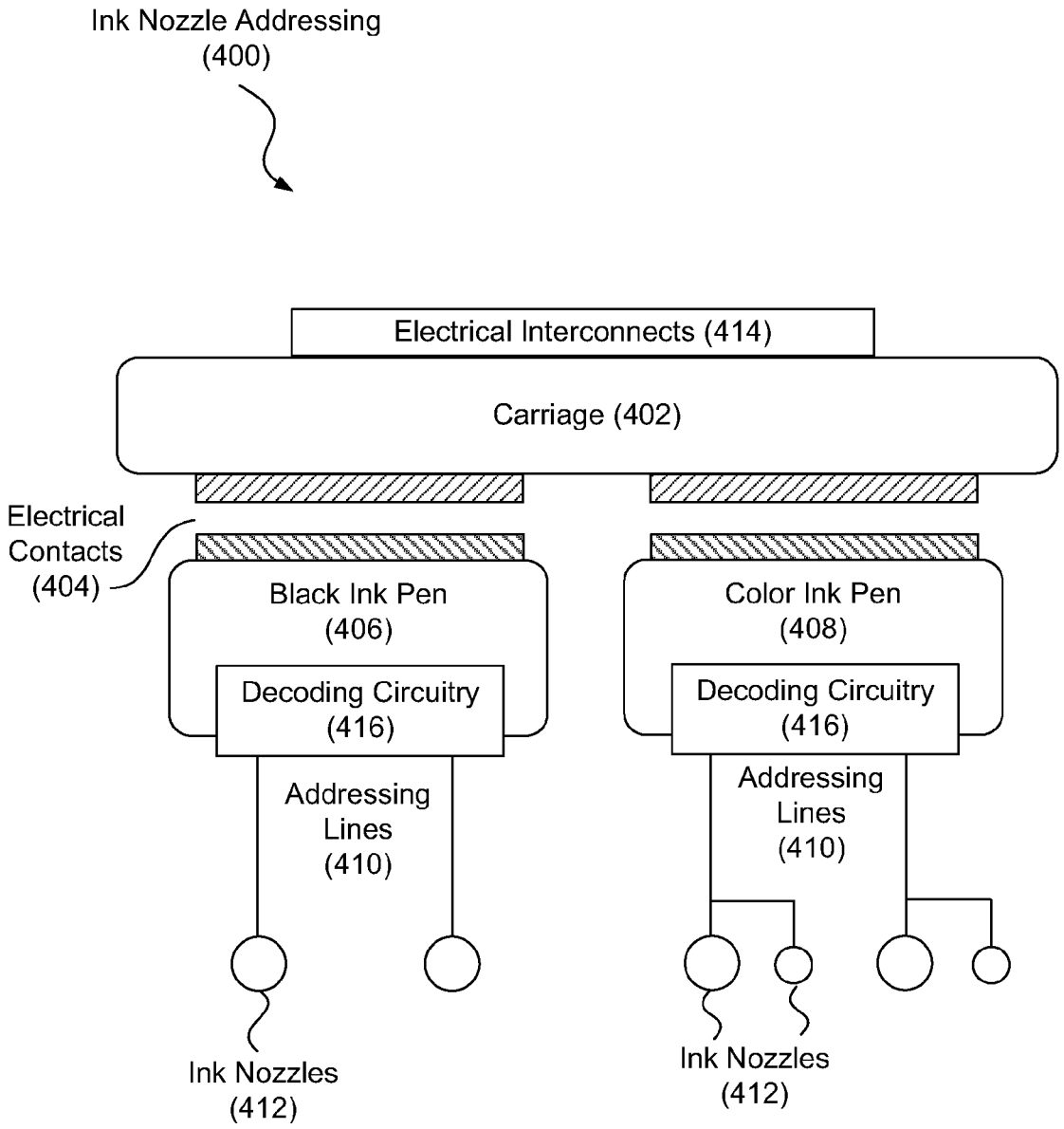
FIG. 4 is a diagram showing illustrative inkjet nozzle addressing, according to one example of principles described herein.

FIG. 4 is a diagram showing illustrative inkjet nozzle addressing. According to certain illustrative examples, at least one of the ink pens may be designed to have more than one physical nozzle controlled by each address line. For example, the black ink pen may include one physical nozzle for each address line. While, the color ink pen may have more physical nozzles than the number of address lines. Thus, the color ink pen may contain more physical nozzles while having the same number of addressable nozzles as the black ink pen. This may allow both cartridges to be electrically identical while the color ink pen includes more physical nozzles.

FIG. 4 illustrates the route taken by electrical signals from the electrical interconnects (414) of the carriage (404) down to the actual ink nozzles (412). After being received by the electrical interconnects, a signal may be routed to the electrical contacts (404) of the electrical interface between the carriage (402) and the ink pens (406, 408). Each ink pen (406, 408) of an ink cartridge may receive the electrical signal and put it through decoding circuitry (416) which outputs signals on the addressing lines (410).

As can be seen in FIG. 4, each of the ink nozzles of the black ink pen has its own corresponding addressing line (410). Thus, each physical ink nozzle (412) within the black ink pen (406) may be individually selected. However, the color ink pen (408) is illustrated as having two ink nozzles (412) per addressing line (410). Thus, when a signal is sent to a particular ink nozzle (412), that signal also can be received by a second ink nozzle (412) connected to the same address line (410). Methods for selectively firing one of the two ink nozzles on the same addressing line are disclosed in a concurrently filed patent application by the present inventors.

In one example, the black ink pen (406) may include a total of 336 physical nozzles and 336 addressable nozzles. Thus, each of the physical nozzles may be uniquely addressed. Given the same number of addressing lines, the color ink pen (408) may include 336 address lines for 112 yellow nozzles, 112 magenta nozzles, and 112 cyan nozzles. The color ink pen (408) may include two physical nozzles for each address line for a total of 672 physical nozzles, 224 physical nozzles for each color. Thus, although having the same number of address lines, the color ink pen (408) has twice the physical nozzles as the black ink pen (406). This provides a higher performance print job while maintaining the lower cost of having fewer addressable nozzles.

In some examples, the second nozzle associated with each address line (410) may be of a different size than the first nozzle. Through use of a different nozzle size, a higher performance print job may be realized.

The elements illustrated in FIG. 4 are not indicative of a specific structure. Rather, the elements are used to illustrate the relation and purpose of the elements illustrated.

Figure 5:
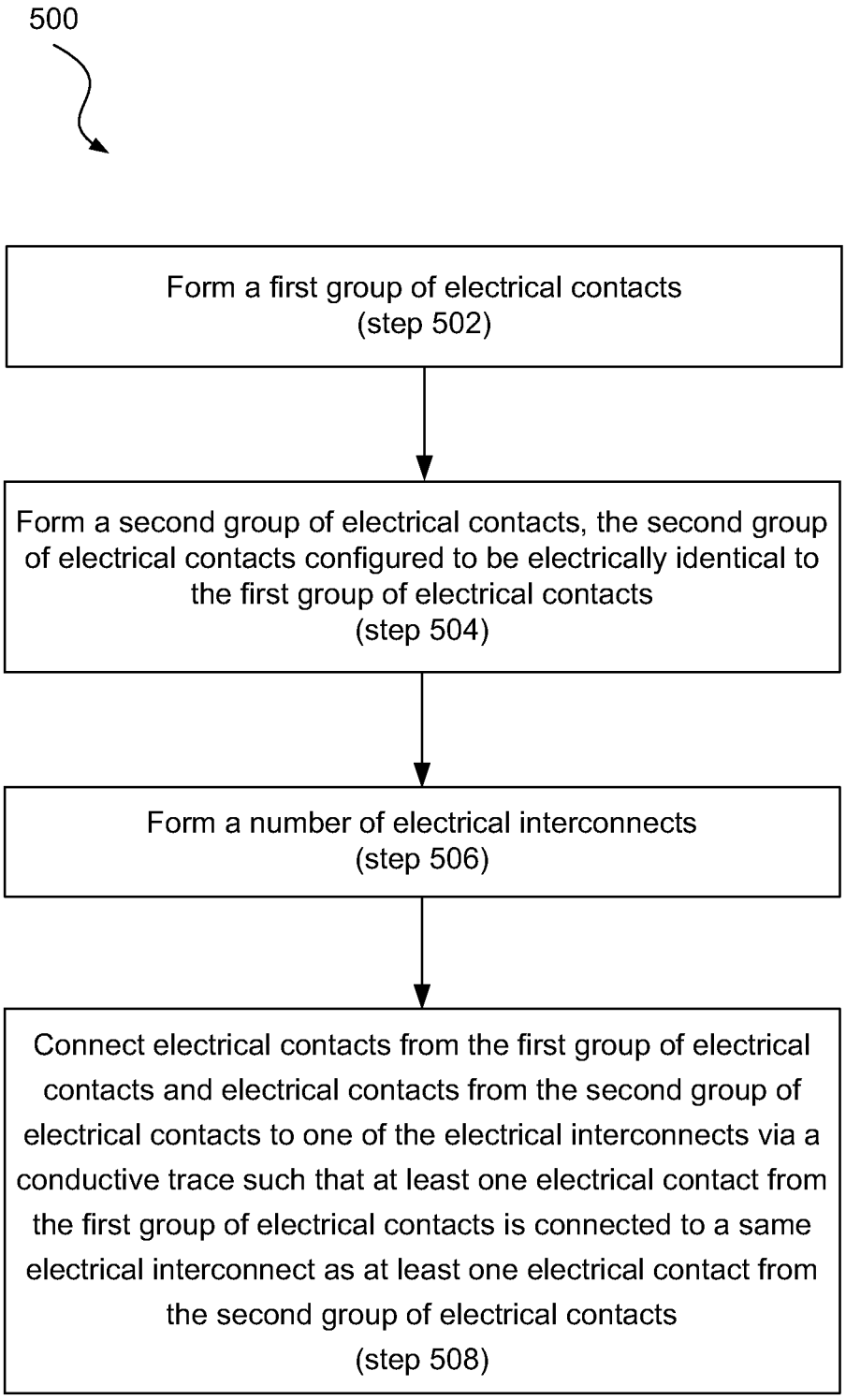
FIG. 5 is a flowchart showing an illustrative method for manufacturing an electrical interface for ink cartridges of an inkjet printer, according to one example of principles described herein.

FIG. 5 is a flowchart showing an illustrative method (500) for manufacturing an electrical interface for ink pens of an inkjet printer. According to certain illustrative examples, the method (500) may include forming (block 502) a first group of electrical contacts; forming (block 504) a second group of electrical contacts, the second group of electrical contacts configured to be electrically identical to the first group of electrical contacts; forming (block 506) a number of electrical interconnects; and connecting (block 508) electrical contacts from the first group of electrical contacts and electrical contacts from the second group of electrical contacts to one of the electrical interconnects via a conductive trace such that at least one electrical contact from the first group of electrical contacts is connected to a same electrical interconnect as at least one electrical contact from the second group of electrical contacts.

In sum, through use of a printing system embodying principles described herein, a high performance printing system at a lower cost may be realized. The cost may be reduced by having a smaller electrical interface. The electrical interface may be smaller due to the electrical contacts for the black ink pen and the electrical contacts for the color ink pen being electrically identical. Additionally, the size may be reduced by the sharing of electrical interconnects between electrical contacts of both groups.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing system comprising an electrical interface for ink pens of an inkjet printer, the electrical interface comprising:

a first group of electrical contacts;

a second group of electrical contacts, said second group of electrical contacts being arranged in an identical configuration as said first group of electrical contacts, wherein the electrical contacts are configured to physically contact corresponding electrical contacts when one of the ink pens is installed in the inkjet printer to electrically interface the pen and inkjet printer, and wherein the first group of electrical contacts and the second group of electrical contacts provide an interface for different, respective pens; and a number of electrical interconnects, in which each electrical contact from said first and second groups of electrical contacts is connected to one of said electrical interconnects via a conductive trace;

in which at least one electrical contact from said first group of electrical contacts is connected to a same electrical interconnect as at least one electrical contact from said second group of electrical contacts.

2. The system of claim 1, in which said first group of electrical contacts interface with a color ink pen and said second group of electrical contacts interface with a black ink pen.

3. The system of claim 1, further comprising a first ink pen interfacing with said first group of contacts and a second ink pen interfacing with said second group of contacts.

4. The system of claim 3, in which said ink pen interfacing with said first group of electrical contacts comprises more physical nozzles than said ink pen interfacing with said second group of electrical contacts.

5. The system of claim 4, in which each of said ink pens comprises a same number of addressing lines.

6. The system of claim 3, in which nozzles of one of said pens are of different sizes.

7. A method for fabricating an electrical interface for a printing system with first and second groups of electrical contacts, each group being disposed in an identical configuration, wherein the electrical contacts are configured to physically contact corresponding electrical contacts when an ink pens is installed in the printing system to electrically interface the pen and printing system, and wherein the first group of electrical contacts and the second group of electrical contacts provide an interface for different, respective pens, the method comprising:

connecting electrical contacts from said first group of electrical contacts and electrical contacts from said second group of electrical contacts to one of a number of electrical interconnects via a conductive trace;

in which at least one electrical contact from said first group of electrical contacts is connected to a same electrical interconnect as at least one electrical contact from said second group of electrical contacts.

8. The method of claim 7, in which said first group of electrical contacts interfaces with a color ink pen and said second group of electrical contacts interfaces with a black ink pen.

9. The method of claim 7, in which an ink pen interfacing with said first group of electrical contacts comprises a same number of addressing lines as an ink pen interfacing with said second group of electrical contacts.

10. The method of claim 9, in which said ink pen interfacing with said first group of electrical contacts comprises more physical nozzles than said ink pen interfacing with said second group of electrical contacts.

11. The method of claim 10, in which each addressing line of said pen interfacing with said first group of electrical contacts comprises at least two physical nozzles.

12. The method of claim 11, in which said at least two physical nozzles are different sizes.

13. A printing apparatus to utilize an electrical interface for ink pens, said electrical interface comprising:

a first group of electrical contacts interfacing with a color ink pen;

a second group of electrical contacts interfacing with a black ink pen, said second group of electrical contacts electrically identical to said first group of electrical contacts; and a number of electrical interconnects, electrical contacts from said first group of electrical contacts and electrical contacts from said second group of electrical contacts being connected to one of said electrical interconnects via a trace;

in which at least one electrical contact from said first group of electrical contacts is connected to a same electrical interconnect as at least one electrical contact from said second group of electrical contacts.

14. The printing apparatus of claim 13, in which an ink pen interfacing with said first group of electrical contacts comprises a same number of addressing lines as an ink pen interfacing with said second group of electrical contacts.

15. The printing apparatus of claim 14, in which said ink pen interfacing with said first group of electrical contacts comprises more physical nozzles than said ink pen interfacing with said second group of electrical contacts.

16. The system of claim 1, in which the electrical contacts that share an electrical interconnect correspond to ground lines, select lines, clock lines, or combinations thereof.

17. The system of claim 1, in which the electrical interconnects communicate with a control system via a number of flexible wires.

* * * * *